US007222758B1

(12) United States Patent
Scheindel

(10) Patent No.: US 7,222,758 B1
(45) Date of Patent: May 29, 2007

(54) VALVE STEM STABILITY IN PRESSURIZED DISPENSING CONTAINERS

(76) Inventor: Christian T. Scheindel, 2065 Ridge Rd., Randolph Center, VT (US) 05061

( * ) Notice: Subject to any disclaimer, the term of this patent is extended or adjusted under 35 U.S.C. 154(b) by 337 days.

(21) Appl. No.: 11/018,278

(22) Filed: Dec. 21, 2004

(51) Int. Cl.
*B65D 83/00* (2006.01)

(52) U.S. Cl. ..... 222/402.21; 222/402.15; 222/402.13; 222/402.22

(58) Field of Classification Search ..... 222/402.13, 222/402.15, 402.21, 402.22, 402.23, 402.24, 222/402.1, 182, 153.11, 153.12; 239/577; 251/340, 349, 149.8
See application file for complete search history.

(56) References Cited

U.S. PATENT DOCUMENTS 2,914,224 A * 11/1959 Michel ..... 222/402.22
3,506,241 A * 4/1970 Ewald ..... 251/354
3,735,955 A * 5/1973 Kerr et al. ..... 251/303
4,436,229 A * 3/1984 Beard ..... 222/402.22
4,450,985 A * 5/1984 Beard ..... 222/402.22
4,550,865 A * 11/1985 Hirao et al. ..... 222/402.21
6,637,627 B1 * 10/2003 Liljeqvist et al. ..... 222/402.15
6,874,663 B2 * 4/2005 Scheindel ..... 222/402.15

* cited by examiner

*Primary Examiner*—Frederick C. Nicolas
(74) *Attorney, Agent, or Firm*—Reed Smith LLP

(57) ABSTRACT

A standard stem and nozzle arrangement for a pressurized dispensing container which dispenses product such as caulk, has an engagement that holds the stem to the sealing boot so that when the nozzle is rotated, the stem will stay in place. Thus, any binding between nozzle and stem due to cured or dried dispensed product can be overcome by twisting the nozzle hard enough to break such a seal without causing the stem to rotate. The engagement is shown as a set of wedge-like projections that extend up from the button of the stem into the resilient sealing boot.

12 Claims, 3 Drawing Sheets

VALVE STEM STABILITY IN PRESSURIZED DISPENSING CONTAINERS

BACKGROUND OF THE INVENTION

This invention relates to a mechanism for preventing the valve stem in a pressurized dispensing container from rotating when the nozzle around the stem is rotated.

The problem arises in pressurized dispensing containers where the product dispensed, such as caulk, gets between the nozzle and the valve stem. The product dries or cures and creates a seal or adhesion between the outside of the valve stem and the inside wall of the nozzle.

When that occurs, it becomes difficult to rotate the nozzle relative to the valve. Such rotation is useful, either partially so as to provide a new position of the nozzle on the valve stem or to remove the nozzle for cleaning.

Accordingly, it is a major object of this invention to provide a structure that will allow rotation of the nozzle without causing the stem to rotate where the nozzle has to be rotated with a force sufficient to break the binding effect of the dispensed product that seeps between the valve stem and nozzle.

It is a related purpose of this invention to achieve the main object in an inexpensive fashion with a design which does not modify or compromise the dispensing operation of the container.

BRIEF DESCRIPTION

In brief, one embodiment of this invention employs two projections which extend upward from the side of the button that is at the base of the valve stem. These two projections engage the side surface of the resilient sealing boot that provides sealing between the valve stem and the container body. These projections are wedges that are held in the resilient boot by virtue of substantial pressure (for example, about 100 pounds per square inch) that is exerted by the pressurized contents on the valve button. This pressure assures continued engagement between these projections or wedges and the resilient boot.

When the nozzle is rotated and there is a binding effect due to dispensed product between nozzle and stem, the stem is held against rotation by the engagement of the projections from the valve into the boot. The projections have to be sized to provide the engagement necessary to overcome the force required to break the seal between nozzle and stem from the dispensed product. Thus, the size, and perhaps even the deployment, of the projections, may be a function of the product involved.

BRIEF DESCRIPTION OF THE DRAWINGS

In FIG. 4, the resilient boot is deleted.

DESCRIPTION OF THE PREFERRED EMBODIMENTS

Figure 1:
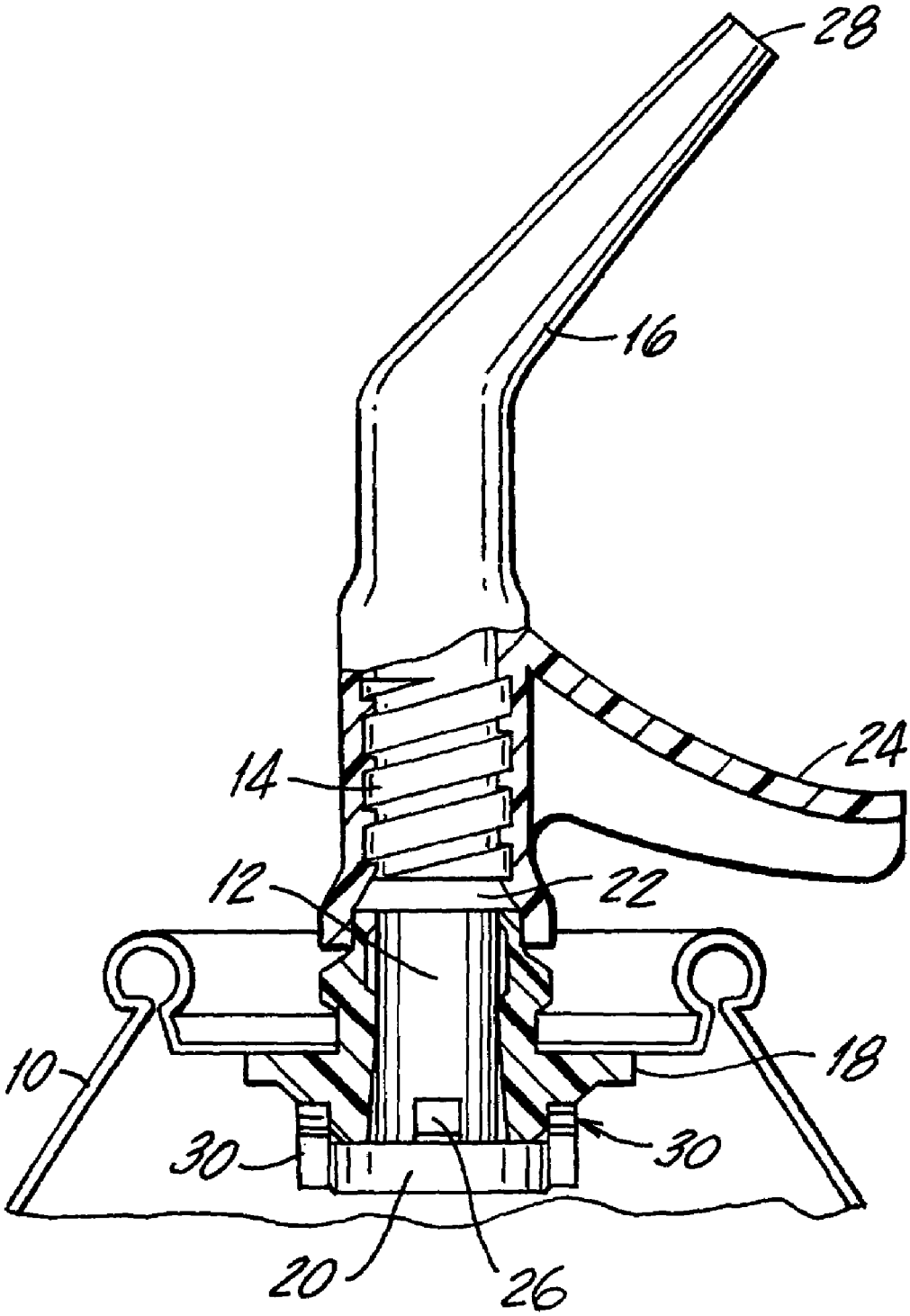
FIG. 1 is a side view, in partial section, showing the arrangement between the valve stem 12, boot 18 and the top of the container body which arrangement incorporates the projections 30 taught by this invention.

The FIGs. all disclose a single embodiment. A pressurized dispensing container 10 has a top central opening through which the valve extends. The stem 12 of the valve is a partially threaded 14 stem and engages the threaded inner surface of the nozzle 16. A resilient boot 18 extends along the lower portion of the surface of the valve 14 stem and is held between the button 20 at the base of the valve stem and a downwardly facing ledge 22 on the valve stem. The nozzle 16 has a handle 24. When the handle 24 is pressed by the user, the nozzle engaging the valve stem forces the valve to tilt sufficiently so that one or more of the valve stem openings 26 are exposed to the product held under pressure within the interior of the container 10. The product under pressure will then be forced through one or more of the openings 26 into the central axial passageway (not shown) of the valve stem to exit from an opening (not shown) at the top of the valve stem into the interior of the nozzle 16 so as to be dispensed at the opening at the upper end 28 of the nozzle.

Some of this material will seep down into the space between nozzle 16 and valve stem 14. When this material cures or hardens or sets, it tends to act as an adhesive between nozzle 16 and valve stem 14 making it difficult to rotate the nozzle relative to the valve stem.

Where, for example, it is desirable to unscrew the nozzle 16 so as to remove it to clean it out, it may become impractical to separate the nozzle and valve stem because rotation of the nozzle 16 will cause the valve stem 14 to rotate and track with the nozzle.

Figure 2:
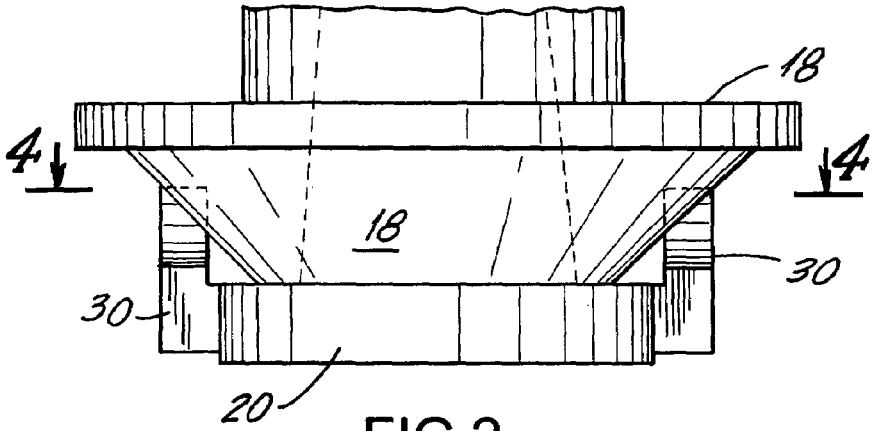
FIG. 2 is a view, in a larger scale than FIG. 1, of the zone around the position where the projections 30 and the valve button 20 engage the resilient boot 18.
Figure 3:
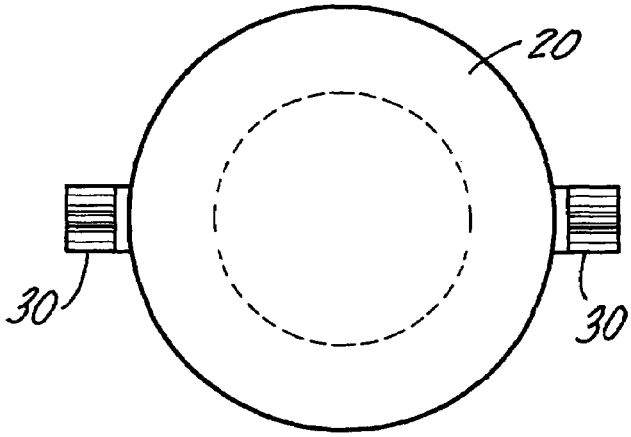
FIG. 3 is a bottom view of the button 20 and one projection 30.
Figure 4:
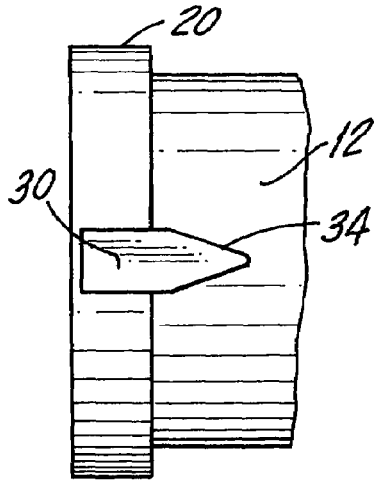
FIG. 4 is a view along the plane 4—4 of FIG. 2 of the valve stem 12, valve button 20 and the two projections 30.
Figure 5:
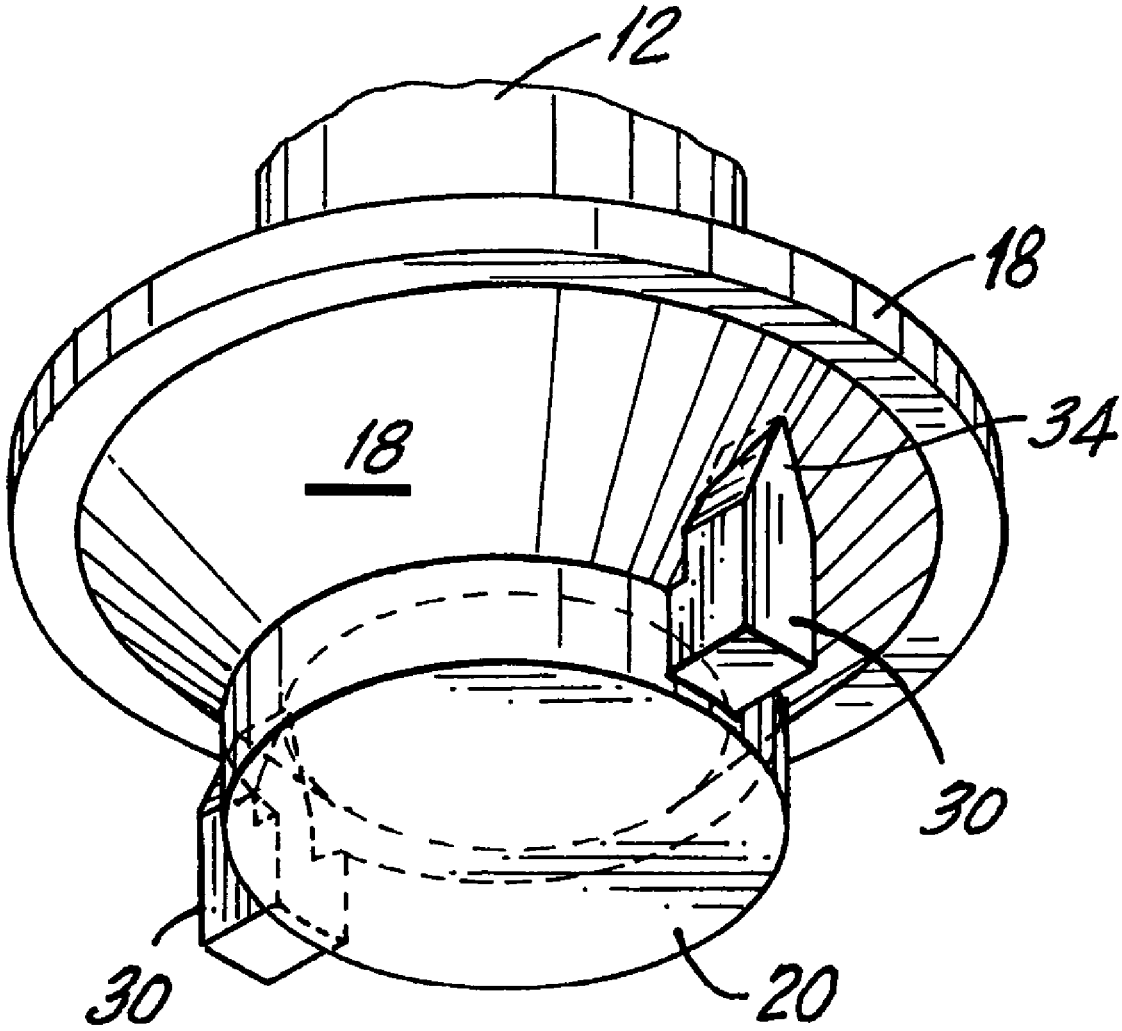
FIG. 5 is a perspective view from underneath the button 20 showing the projections 30 engagement with the resilient sealing boot 18.

As may best be seen in FIGS. 2 through 5, the device of this invention involves two projections 30 which project upward from the side of the valve button 20. Wedge portions 34 project into the resilient boot 18. These projections 30 are held into engagement with the resilient boot 18 by the force applied to the button 20 by the pressurized product that is to be dispensed.

In one embodiment employing a caulk product, the projections 30 each have a base portion and a symmetrically pointed wedge portion 34 that extends into the sloping side of the sealing boot 18.

When the nozzle 16 is to be rotated, the user turns the nozzle hard enough to break any seal, due to cured product, between nozzle 16 and valve stem 12, 14. The projections 30, and particularly the wedge portions 34, holds the valve 12 in position.

Although the embodiment of this invention has been described in detail, it should be apparent to those skilled in the art that various modifications can be made without departing from the scope and teachings of this invention. The scope of the invention is set forth in the claims. It is not intended for those claims to be limited by the specific embodiment shown.

For example, although two wedges like projections 30 are shown and are preferred, any number of projections can be employed. It should be understood herein that the reference made herein to a set of projections is to a set that contains anywhere from one projection to any number desired. Applicant believes that in most cases two projections would be enough and that at least two projections should be used in order to assure a circumferential balance in the holding between the boot 18 and the valve button 20.

The embodiment disclosed employs two projections 30 which are positioned radially outboard of the valve button 20. The projections, or at last the wedge portion thereof, could be placed on the upper surface of the button. But that design is less preferred because it runs the risk of lifting the lower surface of the boot sufficiently off of the button to cause some loss of sealing.

The embodiment disclosed employs a tilt valve design in which the nozzle is threaded on the stem. The problem to which the invention is addressed can occur in connection with the dispensing of product employing a valve that is actuated in an up-down direction and also to a design in which the nozzle is not threaded on the stem. Accordingly, it should be understood that this invention applies to such designs as well as other pressurized dispensing container designs.

It should be noted that the valve has to be an assembled product before being mounted on the container and before product is loaded into the container. During assembly, the valve and boot have to be forced together in a fashion that will cause the projections to engage the boot. During use, the pressure of the product assures continued engagement.

What is claimed is:

1. In a dispensing container having a valve with a stem, a nozzle around the stem and a resilient boot for sealing the nozzle stem to the container wherein the sealing boot extends along the side of the stem, the improvement comprising:

a projection set on the valve stem extending into the resilient boot to engage the resilient boot and the valve, each member of said set being sized so that said valve stem is held against rotation when the nozzle is rotated with a force that overcomes the binding effect between nozzle and valve stem due to cured or dried dispensed product.

2. The improvement of claim 1 wherein: each member of said projection set is positioned radially outward from the outer rim of the button and extends upward into engagement with a side surface of the boot, which surface does not otherwise engage the button of the stem.

3. The improvement of claim 1 wherein: the number of said projections in said set is two.

4. The improvement of claim 2 wherein: the number of said projections in said set is two.

5. The improvement of claim 1 wherein: each member of said projection set includes a base portion extending radially outward from the button and a wedge portion extending upward from said base portion, an inboard side of said wedge portion being radially outboard from the outer edge of the button.

6. The improvement of claim 5 wherein: the number of said projections in said set is two.

7. The improvement of claim 5 wherein: said wedge portion engages a side surface of the boot, which surface does not otherwise engage the button.

8. The improvement of claim 7 wherein: the number of said projections in said set is two.

9. In a dispensing container having a valve with a stem, a nozzle around the stem and a resilient boot for sealing the nozzle stem to the container wherein the sealing boot extends along the side of the stem from the top of the button at the base of the stem, the improvement comprising:

a plurality of upward projections on the valve button extending into the resilient boot to engage the resilient boot and the valve, said projections being sized so that said valve stem is held against rotation when the nozzle is rotated with a force that overcomes the binding effect between nozzle and valve stem due to cured or dried dispensed product.

10. The improvement of claim 9 wherein: the number of said projections is two, spaced substantially 180 degrees from one another.

11. The improvement of claim 9 wherein: each of said projections is a wedge attached to the outer rim of the button and engaging a side surface of the boot, which surface does not normally engage the button of the stem.

12. The improvement of claim 11 wherein: the number of said projections is two, spaced substantially 180 degrees from one another.

* * * * *